United States Patent [19]

Keith

[11] Patent Number: 4,617,946

[45] Date of Patent: Oct. 21, 1986

[54] TOBACCO SMOKE MOUTHPIECE AND METHOD OF MAKING SAME

[75] Inventor: Charles H. Keith, Charlotte, N.C.

[73] Assignee: Brown & Williamson Tobacco Corporation, Louisville, Ky.

[21] Appl. No.: 670,109

[22] Filed: Nov. 9, 1984

[51] Int. Cl.[4] ..... A24B 3/04

[52] U.S. Cl. ..... 131/336; 131/339

[58] Field of Search ..... 131/336, 339

[56] References Cited

U.S. PATENT DOCUMENTS 3,789,855 2/1974 Norman ..... 131/336

*Primary Examiner*—V. Millin

*Attorney, Agent, or Firm*—Charles G. Lamb

[57] ABSTRACT

A tobacco smoke mouthpiece and method of manufacture therefor, the mouthpiece including a formed rod having spaced, opposed, axially aligned, open-ended tobacco smoke inlet and outlet chambers and at least one apertured mixing chamber therebetween, the rod being surrounded by apertured tipping material to allow passage of smoke diluting air into the mixing chamber and through at least one of the opposed communicably connected chambers.

10 Claims, 8 Drawing Figures

TOBACCO SMOKE MOUTHPIECE AND METHOD OF MAKING SAME

BACKGROUND OF THE INVENTION

1. Field of the Invention

The present invention relates to tobacco smoke ventilating assemblies and, more particularly, to an improved tobacco smoke mouthpiece which reduces tar by ventilation and a novel method of making the same.

2. Description of the Prior Art

It is well known in the smoking tobacco art to form tobacco smoke mouthpiece and/or filter assemblies at one end of smoking articles, the assemblies being provided with ventilating means to introduce ambient air into the assemblies to dilute tobacco smoke as it flows through the assemblies. The ventilation means serves to reduce the quantity of smoke particulates and gas phase components delivered to the mouth of the smoker.

It also is generally well known in the smoking tobacco art to manufacture such tobacco smoke ventilating assemblies from axially extending filamentous material which is formed into longitudinally extending rods, crimped and then cut to produce unit inner tobacco smoke assemblies which are subsequently overwrapped with tipping materials, some of such unit assemblies being provided with grooved outer walls or channels for smoke or ventilating air passages and some of the tipping materials being air permeable. For example, U.S. Pat. No. 3,637,447, issued to Richard M. Berger et al, on Jan. 25, 1972; No. 3,690,326 issued to Francis R. Davenport on Sept. 12, 1972; and No. 3,805,682, issued to Henry Lyon et al, on Apr. 23, 1974, all teach such formed and crimped inner tobacco smoke units. Attention also is further directed to U.S. Pat. No. 3,533,416; No. 3,599,646; No. 3,648,711; No. 3,994,306; No. 4,022,221; No. 4,026,306; and No. 4,075,936; all of which further suggest such arrangements. However, none of these abovenoted patents teaches or suggests the novel concept of applicant's present invention which, recognizing the importance of a thorough dilution of smoking tobacco and an appropriate diverting delivery of such diluted smoking tobacco to the smoker's mouth, provides a stable, sturdy mouthpiece assembly which accomplishes the same in a straightforward manner with a minimum of parts and material, utilizing a mixing chamber to do so. In addition, the present invention provides a novel method of manufacturing such tobacco mouthpiece assemblies in a series of straightforward, comparatively inexpensive steps, each of which requires comparatively inexpensive and uncomplicated manufacturing equipment in practicing the method steps.

Various other features of the present invention will become obvious to one skilled in the art upon reading the disclosure set forth herein.

SUMMARY OF THE INVENTION

More particularly, the present invention provides an improved tobacco smoke mouthpiece comprising: a longitudinally extending assembly of structurally sturdy forming material shaped and disposed to include spaced, opposed, axially aligned, open-ended tobacco smoke inlet and outlet chambers and at least one mixing chamber disposed therebetween with the opposed open-ended chambers being communicably connected; an enveloping tipping material surrounding the chambers; and aperture means in the tipping material and the chamber forming material to allow ready passage of smoke diluting air through the tipping material into the mixing chamber and through at least one of the opposed communicably connected chambers.

In addition, the present invention provides a novel method to manufacture tobacco smoke mouthpiece units including forming a hollow longitudinally extending tubular rod from structurally sturdy, shapeable material, collapsing the tubular rod at spaced intervals axially along the rod to provide spaced, axially aligned chambers connected by flow-through conduits therebetween; piercing selected chambers to provide pierced and unpierced chambers; cutting the rod at selected chambers to provide reduced rods of manageable size with spaced, opposed, axially aligned, open-ended tobacco smoke inlet and outlet chambers and at least one mixing chamber therebetween; and wrapping the reduced rods with apertured tipping material, the apertures being so positioned along the reduced rod and the mixing chambers to allow passage of smoke diluting or ventilating air through the tipping material into the mixing chamber and through at least one of the opposed communicably connected chambers.

It is to be understood that various changes can be made by one skilled in the art in the arrangement, form, shape and construction of the inventive product disclosed and in the several steps of the inventive method disclosed without departing from the scope or spirit of the present invention.

BRIEF DESCRIPTION OF THE DRAWING

Figure 1:
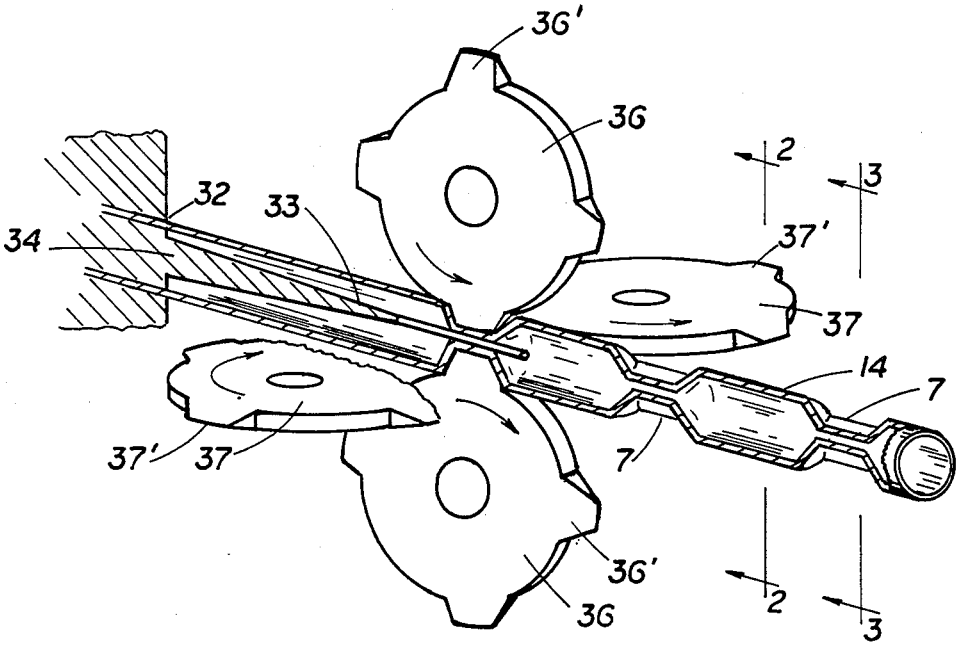
FIG. 1 is an enlarged, schematic perspective view of an extrusion die and crimping wheel arrangement which discloses several of the inventive steps involved in manufacturing mouthpiece rods for the improved tobacco smoke mouthpiece of the present invention.
Figure 2:
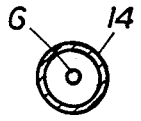
FIG. 2 is a cross-sectional view through line 2—2 of FIG. 1 disclosing a cross-section of one of the chambers of the rod produced by the arrangement of FIG. 1.
Figure 3:
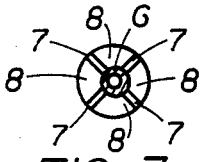
FIG. 3 is a cross-sectional view through line 3—3 of FIG. 1 disclosing a cross-section of one of the ribbed capillary passages of the rod produced by the arrangement of FIG. 1.

Referring to the drawing which discloses an advantageous embodiment of the inventive product and a modification thereof and an inventive method for making each of the products:

Referring to FIGS. 3 to 6 of the drawing, the improved tobacco smoke mouthpiece of the present invention is disclosed as a generally cylindrical, smoke impervious, rod member 2 shaped from a suitable material such as polyethylene, to include spaced, opposed, axially aligned, open-ended tobacco smoke inlet chamber 3 and mouth end outlet chamber 4, directly connected to each other by longitudinally extending, axially aligned conduit 6 which defines a capillary passage to connect chambers 3 and 4. As can be seen in FIG. 3, conduit 6 is provided with spaced ribs 7 which extend in a radial fashion therefrom between and connected to opposite extremities of chamber 3 and 4, the ribs 7 defining a cruciform cross-section to provide mixing chambers 8 surrounding conduit 6. A suitable tipping paper 9 having a row of spaced openings 11 positioned to communicate with chambers 8, envelopes chambers 3, 4 and 8 and the adjacent extremity of tobacco rod 12 to form a filter tipped smoking article or cigarette. It is to be noted that in the embodiment disclosed, the open-ended tobacco inlet chamber 3 is provided with a plurality of openings 13 to allow passage of smoke diluting air through the openings 11 in tipping paper 9 into mixing chambers 8 and openings 13 and through opposed chambers 3 and 4 communicably connected by conduit 6.

It is to be understood that relative sizes, materials, dimensions, geometries, locations and spacings of the aforedescribed chambers, capillary passages and spaced openings can be varied in accordance with results desired without departing from the scope or spirit of the present invention. For example, openings could be provided in the other or both chambers 3 and 4 or even in conduits 6 and the number of ribs 7 and their disposition to the mixing chambers 8 could be modified.

Figure 5:
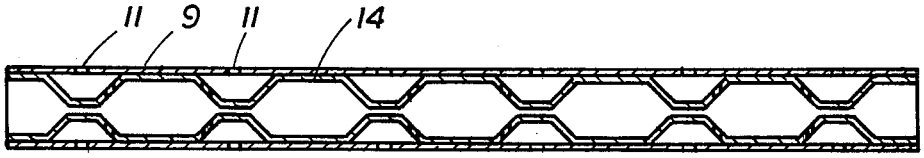
FIG. 5 is an enlarged side view of a pierced rod section.
Figure 6A:
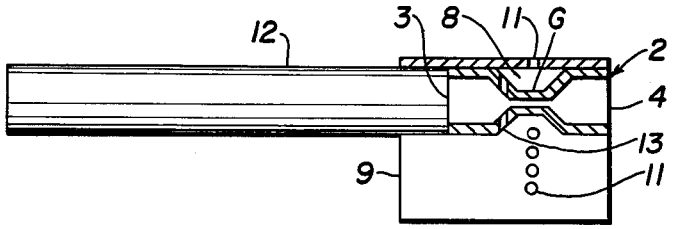

In FIG. 5, it can be seen that each rod member 2 of FIG. 6 can be cut from a rod section 14 which is formed, pierced, cut and assembled in the novel manner described hereinafter.

Figure 7:
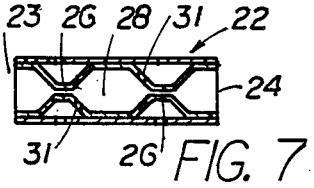
FIG. 7 is a reduced side view of another embodiment of the inventive tobacco smoke mouthpiece, the mouthpiece having the mixing chamber aligned with the opposed smoke inlet and outlet chambers.

Referring to FIG. 7 of the drawing, a modified tobacco smoke mouthpiece of the present invention formed from a rod section similar to rod section 14 is disclosed. This tobacco smoke mouthpiece of FIG. 7 also is disclosed as a generally cylindrical, smoke impervious rod member 22, also shaped from a suitable material such as polyethylene to include spaced, opposed, axially aligned, open-ended tobacco smoke inlet and outlet or mouth chambers 23 and 24 respectively. A mixing chamber 28 is also provided in this modified arrangement, but mixing chamber 28 of FIG. 7, unlike mixing chamber 8, is axially aligned with inlet and outlet chambers 23 and 24 and a pair of longitudinally extending, axially aligned conduits 26 are provided on either side of mixing chamber 28 to define capillary flow through passages to connect chambers 23 and 24 to mixing chamber 28. In a manner similar to that aforedescribed for conduits 6, conduits 26 can be provided with spaced ribs (not shown in detail in FIG. 7) to define a cruciform cross-section providing air chambers therebetween. It is to be noted that mixing chamber 28 is provided with suitable openings 31 at opposite extremities thereof. Accordingly, when tipping paper having two suitably spaced rows of spaced apertures is arranged to surround aligned chambers 23, 28 and 24 and the rib defined air chambers in a manner similar to that aforedescribed for the structure of FIG. 6, except with the spaced rows of apertures communicating with the air chambers formed between the ribs, the openings in the tipping paper and in mixing chambers 28 allow passage of smoke diluting air through the tipping paper into mixing chamber 28 and through opposed communicably connected chambers 23 and 24.

As will be described hereinafter, rod members 22 of FIG. 7 can be cut from a suitable rod section like section 14 of FIG. 5, which is formed, pierced, cut and assembled in the novel manner described hereinafter.

Figure 4:
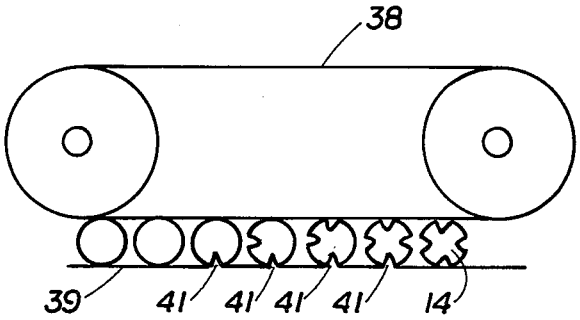
FIG. 4 is a schematic side view of an arrangement for piercing selected chambers of mouthpiece rod sections cut from the tubular rod formed by the apparatus and manufacturing steps of FIG. 1.
Figure 6:
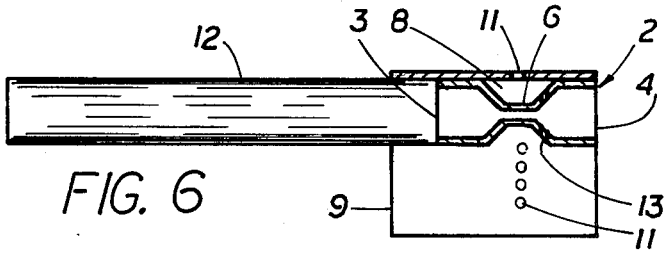
FIG. 6 is an enlarged side view of one embodiment of the inventive tobacco smoke mouthpiece assembled with a tobacco rod, the mouthpiece having the mixing chamber surrounding the capillary passage.

Referring to FIGS. 1–4 of the drawing, the novel method of manufacturing tobacco smoke mouthpieces such as disclosed in FIGS. 5–7 is schematically disclosed. A rod 14 like that disclosed in FIG. 5 is formed from a suitable, smoke impervious, polyethylene, plastic material by extruding the same through an annular die 32. The die 32 has a wire forming member 33 trailing from the center of annulus 34 of the die. Spaced from die 32 a suitable distance therefrom are two sets of spaced, opposed, power driven crimping roll sets 36 and 37. As disclosed, spaced roll set 36 is vetically disposed and spaced roll set 37 is horizontally disposed at right angles thereto adjacent the trailing extremity of wire forming member 33. The spaced rolls of each set serve to crimp, in spaced increments, tubular member 14 as it is extruded from annular die 32, the rolls having spaced peripheral teeth 36' and 37' respectively to provide a tubular rod at spaced, axially extending, aligned, smoke impervious chambers connected to each other by axially disposed capillary flow-through conduits with spaced chamber defining ribs extending radially in crucifom cross-section from the flow-through conduits externally of and connecting adjacent smoke impervious chambers—all as abovedescribed. After the tubular rod member has been crimped by the spaced roll sets, it is then cut into rod sections for manageable handling. It has been found advantageous in the enclosed embodiment to cut the tubular rod intermediate the extremities of every sixth smoke impervious chamber to provide tubular rod sections having five aligned smoke impervious chambers connected to each other by capillary flow-through conduits and bounded by spaced, opposed, axially open-ended chambers—such as the tubular rod section 14 of FIG. 5. The tubular rod sections, after being cut to selected length, are then pressure rolled about their longitudinal axes between the lower flight of a suitably powered, nipping endless conveyor 38 and a spaced piercing platen 39 (FIG. 4). Platen 39 is comprised of a series of spaced rows of spaced tube piercing pins 41. The spaced pins 41 of each row and the spacing of the rows are so distanced relative the tube dimensions to pierce the opposite extremities of the first, third and fifth smoke impervious chambers to provide pierced chambers therefrom (FIG. 5). Once the tubular rod sections 14 have been so pierced, they are then wrapped with suitable tipping paper 9 having axially spaced apertures 11 to allow passage of ventilating or smoke diluting air through the tipping paper into the rib defined chambers and then into the apertured extremities of the pierced chambers. It is to be understood that the present invention is not to be considered as limited to the particular piercing steps described. For example, other piercing arrangements including lasers could be utilized.

To form the mouthpiece assemblies, the tubular rod sections 14 are again cut into mouthpiece assemblies intermediate the extremities of the second and fourth unpierced smoke impervious chambers to provide three open-ended tobacco smoke mouthpiece assemblies from each section, each with a pierced intermediate chamber therebetween.

Depending upon configuration, sizing and results desired, each mouthpiece assembly can then be fastened, as is, to one end of a tobacco rod with or without additional filtering units (not disclosed) to form tipped smoking articles, with mouthpiece units like that disclosed in FIG. 7.

To form smoking articles with mouthpiece units like that of FIG. 6, tobacco rods 12 are assembled to opposed open-ends of each tobacco filter assembly and the assembly then cut between the extremities of the pierced intermediate chamber, forming two mouthpiece tipped smoking articles therefrom, each with a unit like that disclosed in FIG. 6.

As abovenoted, it is to be understood that the configuration, number and geometry of the chambers, passages, locations, number and size of the apertures and geometry and configuration of the ribs can be varied by one skilled in the art to obtain preselected results without departing from the scope or spirit of the present invention.

The invention claimed is:

1. An improved tobacco smoke mouthpiece comprising: a longitudinally extending assembly of structurally sturdy forming material shaped and disposed to include spaced, opposed, axially aligned open-ended tobacco smoke inlet and outlet chambers and at least on mixing chamber disposed therebetween with said opposed inlet and outlet chambers being communicably connected to each other through axially disposed capillary passage means; an enveloping tipping material surrounding said chambers; and aperture means in said tipping material and said chamber forming material to allow ready passage of smoke diluting air through said tipping material into said mixing chamber and through at least one of said opposed communicably connected chambers.

2. The mouthpiece of claim 1, and spaced rib members extending in radial fashion between said opposed axially aligned open-ended tobacco smoke inlet and outlet chambers.

3. The mouthpiece of claim 1, said chamber forming material being plastic, smoke impervious polyethylene.

4. The mouthpiece of claim 1, said chamber forming material comprising a generally cylindrical unitary rod member.

5. The mouthpiece of claim 1, said spaced, opposed, axially aligned, open-ended inlet and outlet chambers being communicably connected directly to each other through an axially disposed capillary passage conduit with said mixing chamber surrounding said capillary passage conduit.

6. The mouthpiece of claim 1, said spaced, opposed, axially aligned, open-ended inlet and outlet chambers being communicably connected directly to each other through an axially disposed capillary passage conduit with said mixing chamber surrounding said capillary passage conduit, said mixing chamber being divided into a plurality of compartments by rib members extending radially outward from said capillary passage conduit.

7. The mouthpiece of claim 1, said mixing chamber being axially aligned and between said spaced opposed inlet and outlet chambers with opposed ends of said mixing chamber being connected to said inlet and outlet chambers by capillary passage conduits and having apertures therein to allow ready passage of smoke diluting air through said tipping material into said mixing chamber.

8. The mouthpiece of claim 7, the space surrounding said capillary passage conduits being divided into a plurality of compartments by rib members extending radially outward from said capillary passage conduits.

9. An improved tobacco smoke mouthpiece comprising a generally cylindrical, smoke impervious, polyethylene rod member shaped to include spaced, opposed, axially aligned, open-ended tobacco smoke inlet and outlet chambers; said inlet and outlet chambers being directly connected to each other by a longitudinally extending, axially aligned conduit defining a capillary flow passage to connect said inlet and outlet chambers; said conduit having spaced ribs extending in radial fashion therefrom between and connected to opposite extremities of said inlet and outlet chambers, said ribs defining a cruciform cross-section to provide mixing chambers therebetween surrounding said conduit; an enveloping tipping paper surrounding said chambers; and openings in said tipping paper and said open-ended inlet chamber to allow passage of smoke diluting air through said tipping material into said mixing chambers and through said opposed communicably connected chambers.

10. An improved tobacco smoke mouthpiece comprising: a generally cylindrical, smoke impervious, polyethylene rod member shaped to include spaced opposed, axially aligned, open-ended tobacco smoke inlet and outlet chambers and a mixing chamber axially aligned therebetween with longitudinally extending, axially aligned conduits therebetween defining capillary flow-through passages connecting said chambers; said conduits having spaced ribs extending in radial fashion therefrom between and connected to opposite ends of said chambers, said ribs defining a cruciform cross-section to provide air chambers therebetween; an enveloping tipping paper surrounding said aligned smoke impervious chambers and said rib defined air chambers therebetween; and openings in said tipping paper adjacent said air chambers and in said mixing chamber to allow passage of smoke diluting air through said tipping paper into said mixing chamber and through said opposed communicably connected chambers.

* * * * *